36-29 Sh

10/15/85 XP 4,546,556

United States Patent [19]

Stubblefield

[11] Patent Number: 4,546,556

[45] **Date of Patent: * Oct. 15, 1985**

[54] BASKETBALL SHOE SOLE

[75] Inventor: Jerry D. Stubblefield, Portland, Oreg.

[73] Assignee: Pensa, Inc., Portland, Oreg.

[ * ] Notice: The portion of the term of this patent subsequent to May 22, 2001 has been disclaimed.

[21] Appl. No.: 571,498

[22] Filed: Jan. 17, 1984

Related U.S. Application Data

[63] Continuation of Ser. No. 250,899, Apr. 3, 1981, Pat. No. 4,449,307.

[51] Int. Cl.[4] ..... A43B 13/04; A43B 13/18; A43B 5/00

[52] U.S. Cl. ..... 36/32 R; 36/29; 36/59 C; 36/114; D2/320

[58] Field of Search ..... 36/25, 28, 29, 30 R, 36/32 R, 59 R, 59 A, 59 C, 67 A, 114, 128, 129, 38, 3 R; D2/319, 320, 321

[56] References Cited

U.S. PATENT DOCUMENTS

| | | | |
|---|---|---|---|
| D. 78,646 | 5/1929 | Oakley | 2/230 |
| 1,653,059 | 12/1927 | Nelson | 36/29 |
| 4,012,855 | 3/1977 | Gardner | 36/59 R |
| 4,041,618 | 8/1977 | Famolare, Jr. | 36/29 |
| 4,044,479 | 8/1977 | Brutting | 36/32 R |
| 4,245,406 | 1/1981 | Landay et al. | 36/32 R |
| 4,259,792 | 4/1981 | Halberstadt | 36/32 R |
| 4,271,606 | 6/1981 | Rudy | 36/29 |
| 4,297,796 | 11/1981 | Stirtz et al. | 36/32 R |

FOREIGN PATENT DOCUMENTS

| | | | |
|---|---|---|---|
| 1097064 | 3/1981 | Canada | 36/32 R |
| 806647 | 5/1952 | Fed. Rep. of Germany | 36/29 |
| 2404803 | 8/1975 | Fed. Rep. of Germany | 36/32 R |
| 2914690 | 10/1979 | Fed. Rep. of Germany | 36/32 R |
| 2412280 | 7/1979 | France | 36/32 R |
| 2457652 | 12/1980 | France | 36/59 R |

*Primary Examiner*—James Kee Chi

*Attorney, Agent, or Firm*—Saidman, Sterne, Kessler & Goldstein

[57] ABSTRACT

An outer sole especially designed for basketball shoes which is lightweight, stable, and provides a greater degree of shock absorption than heretofore possible. The sole includes a plurality of kinetic levers or tread members which extend downwardly and outwardly from the peripheral portion of the bottom of the sole and, together with a relatively stiff, centrally formed pedestal on the inside surface of the sole, define a cantilevered construction that dissipates shock by inducing spreading of the levers laterally outwardly upon foot-induced ground impact. The space between the inner, central pedestal and the side wall of the sole defines a cavity positioned above the respective tread members for facilitating compression and spreading thereof to enhance the shock-dissipating qualities of the sole. The sole also includes a side wall which, together with the upper walls of the tread members, defines a groove. The groove also facilitates compression and spreading of the tread members. The wider than normal base provided by the laterally extending tread members enhances stability and reduces the possibility of ankle twists. The forefoot portion of the bottom of the sole features a transversely extending groove pattern and a pivot stud which together facilitate metatarsal flexure and pivoting which are frequently encountered when playing basketball.

22 Claims, 5 Drawing Figures

BASKETBALL SHOE SOLE

This is a continuation of application Ser. No. 250,899, filed Apr. 3, 1981, now U.S. Pat. No. 4,449,307.

BACKGROUND OF THE INVENTION

1. Field of the Invention

The present invention relates to shoe soles and, more particularly, to a sole which is especially designed for use as the outer sole of a basketball shoe.

2. Description of Related Art

The game of basketball, being primarily a running game, subjects its players to a rather high degree of wear and tear, especially to their legs, knees, ankles and feet.

For example, an average guard in a professional basketball league could very easily run between 4–7 miles per game. Even though the running is not continuous and, in fact, is interrupted by many stops and turns, the sheer amount of shock introduced into the lower limbs of a basketball player is extremely large. Unfortunately, presently known basketball shoes have been designed, by and large, with very little attention being paid to shock absorption or dissipation qualities. A basketball shoe which could reduce the amount of shock being fed back up through the foot, ankle, leg, knee and even back of a player is long overdue.

Many basketball players, in addition to suffering from stress-type fractures as a result of poor shock-absorbing qualities of prior basketball shoes, also suffer from injuries relating to such shoes' instability problems. Clearly, the wider the base of the shoe that contacts the floor, the more stable the particular shoe would be. However, present and previously known basketball shoes are manufactured with a slight side taper which results in a construction that is the antithesis of stability.

Another problem with presently known designs is the sharp definition of the outer edge at the junction between the bottom of the sole and side of the sole. The sharp edge clearly defines a fulcrum which becomes unstable as soon as the center of gravity of the wearer passes over same. It is clear that a basketball shoe which could increase stability by providing a larger base, and which could eliminate the sharp fulcrum (which results in ankle twists and similar injuries) would be highly desirable.

Although my original, basic design of a cantilevered or kinetic running shoe, as set forth in my copending application, Ser. No. 185,957 filed Sept. 10, 1980, now U.S. Pat. No. 4,372,058, is today wellknown, no one has yet applied any of the shock-dissipation features of my design to basketball shoes. Typical basketball shoe designs of which I am aware are exemplified by the following U.S. Pat. Nos. 1,962,526; 1,988,784; and 2,071,431.

My original kinetic lever or cantilevered outer sole design, set forth in my prior application listed above, features means for cushioning the foot and leg of a wearer against impact loads which comprises a plurality of resilient tread members disposed about the peripheral portions of the lower surface of the outer sole, so as to support the central portion of the lower surface in a cantilever fashion. The tread members are inclined downwardly and outwardly from the peripheral portion of the lower surface so as to form a longitudinally and laterally oriented concavity for the outer sole. Each of the tread members includes shock absorbing means for permitting same to be resiliently urged laterally outwardly with respect to the central portion of the lower surface of the outer sole upon impact with the ground.

OBJECTS AND SUMMARY OF THE INVENTION

It is therefore a primary object of the present invention to provide a new and improved outer sole for a basketball shoe which is lightweight and provides excellent stability and shockdissipation and absorption qualities.

A further object of the present invention is to provide a high quality, durable and lightweight basketball shoe sole which dissipates shock away from the foot, ankle, leg and knee of a wearer utilizing my cantilever principle, and also facilitates forefoot flexing and pivoting.

The foregoing and other objects are attained in accordance with one aspect of the present invention through the provision of an outer sole for a shoe which comprises an outer surface having a central portion and a peripheral portion, an inner surface having a central portion and a peripheral portion, and a plurality of resilient tread members integrally extending downwardly and outwardly from the outer surface towards the peripheral portion of the outer surface. The tread members are adapted to be compressed and spread laterally outwardly upon foot-induced ground impact for dissipating shock away from the foot. A side wall extends upwardly from the peripheral portion of the inner surface so as to define cup means adapted to receive a shoe upper therewithin, and cavity means is positioned adjacent the side wall about the peripheral portion of the inner surface under the cup means and above the tread members for facilitating the spreading and compressing of the tread members.

The present invention further includes substantially rigid pedestal means formed in the central portion of the inner surface of the sole for further supporting the upper, the cavity means being defined by the space between the pedestal means and the side wall. A support flange is also preferably provided which extends inwardly from the side wall above the cavity means towards the pedestal means. The support flange is adapted to help support a fibrous board and the upper.

The pedestal means more particularly may include a plurality of main walls which extend transversely across the central portion of the inner surface. Each of the main walls is preferably aligned along the approximate transverse centerline of a respective opposed pair of tread members. The pedestal means may further include main wall support members which extend downwardly and outwardly from the ends of each of the main walls. The main wall support members are preferably substantially triangularly shaped, and form a transition with the tread members to define a bridge-like cantilevered structure. The pedestal means may further include left and right side support walls which connect the end portions of the main walls and which extend longitudinally along the inner surface of the sole. Supplementary support members may also be provided to extend outwardly from the left and right side support walls towards the side wall. Such supplementary support members are preferably of the same height as the central pedestal and are positioned above the spaces formed between respective pairs of adjacent tread members so as not to interfere with their compression and flexing.

The pedestal means and support flange are preferably tapered downwardly from the heel portion of the sole towards the toe portion thereof to a point where the pedestal means is merged into a smooth, forefoot portion of the inner surface. The tread members are not formed about the frontal portion of the sole, which instead includes a herringbone gripper surface or the like. More particularly, the tread members are preferably arranged in pairs along opposed sides of the outer surface and are formed from the heel of the sole to the metatarsal region of the sole.

In accordance with another aspect of the present invention, the tread members preferably extend laterally beyond the junction thereof with the side wall so as to define an inwardly extending groove formed about the outer perimeter of the side wall to facilitate flexing of the tread members thereunder. On the outer surface of the forefoot portion of the sole are preferably provided transverse grooves extending across the metatarsal heads which facilitate flexing of the foot thereat. Means are also preferably formed in the outer surface under the position of the ball of the great toe for facilitating pivoting of the foot. The transversely extending grooves extend concentrically about the pivot means to facilitate simultaneous flexing and pivoting.

BRIEF DESCRIPTION OF THE DRAWINGS

The foregoing and other objects, aspects, uses and advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
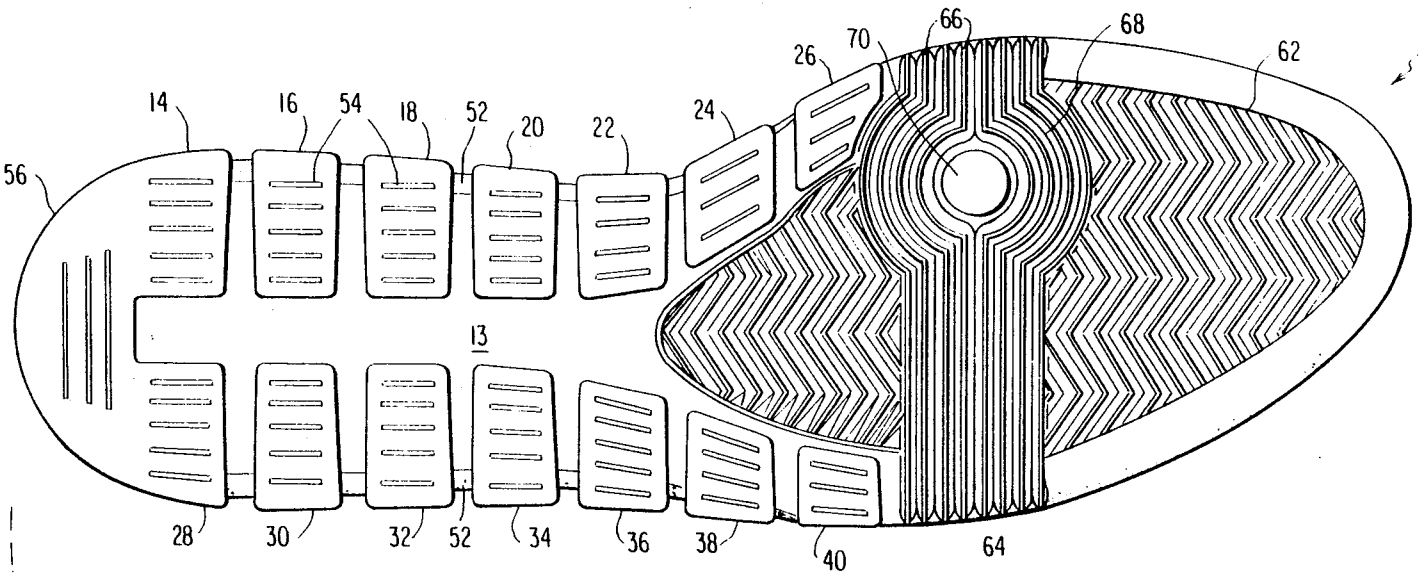
FIG. 1 is a plan view of the outer surface of a preferred embodiment of an outer sole of the present invention.

Referring now to the drawings, wherein like reference numerals represent identical or corresponding parts throughout the several views, and more particularly to FIGS. 1 and 2 thereof, the shoe sole or outer sole of the present invention is indicated generally by reference numeral 10 and is particularly designed for use as the sole of a basketball shoe as will become more clear hereinafter.

The outsole 10 may be made of any suitable material, such as rubber or synthetic plastics. An upper 12 constructed of leather or canvas may be attached by conventional means to outer sole 10. A fibrous board 15 (FIG. 3) may be positioned within outsole 10 as a means for facilitating attachment of upper 12 as is well known by a person of ordinary skill in the art.

Figure 3:
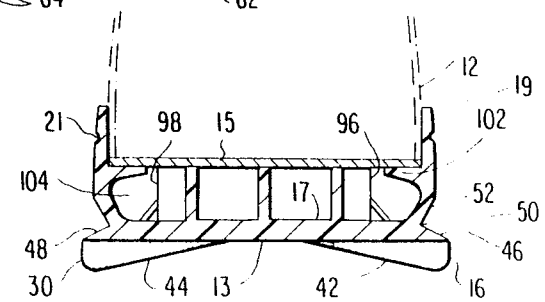
FIG. 3 is a cross-sectional view of the shoe sole of FIG. 2 and taken along line 3—3 thereof.
Figure 4:
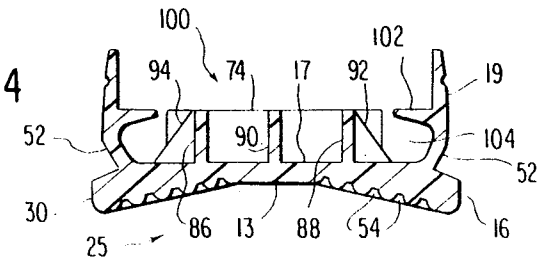
FIG. 4 is a cross-sectional view of the shoe sole of FIG. 2 taken along line 4—4 thereof.
Figure 5:
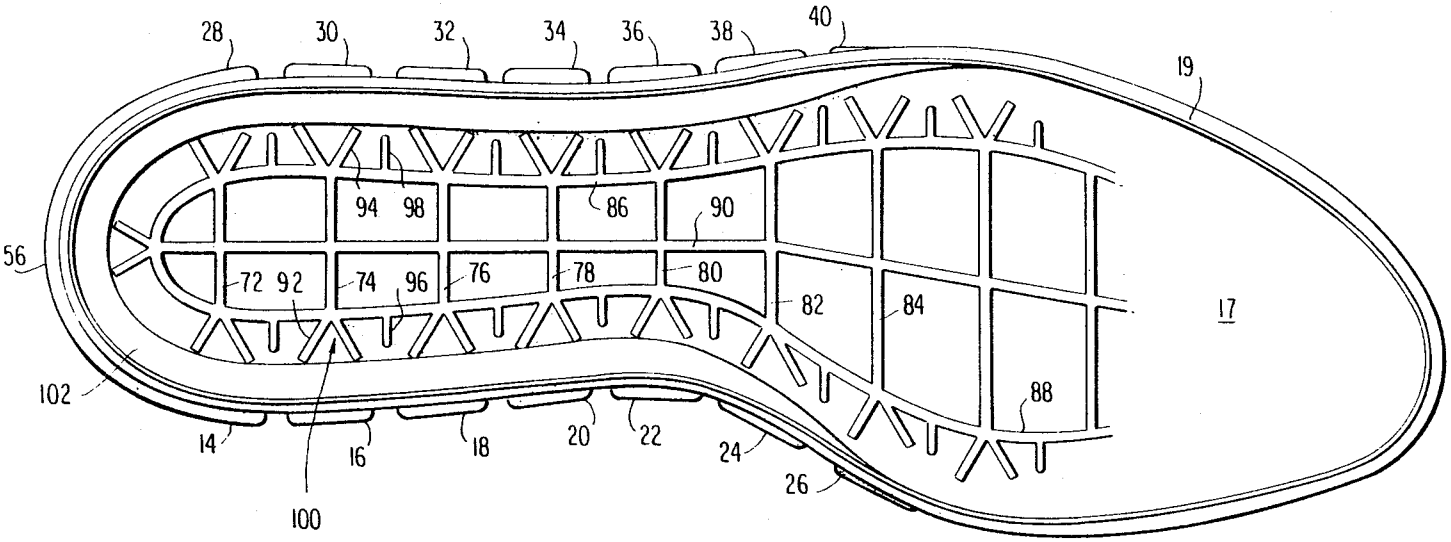
FIG. 5 is a plan view of a preferred embodiment of the inner surface of the outer sole illustrated in FIG. 1.

Outsole 10 includes an outer or bottom surface 13 and an inner or inside surface 17 (FIGS. 4 and 5). A side wall 19 extends upwardly from the peripheral portion of the inner surface 17 so as to define a cup-like recess within which upper 12 is received (FIG. 3). The outside of side wall 19 may be provided with an indent 21 to facilitate stitching of the upper 12 to the outsole 10.

The bottom of the outsole 10 includes, as seen in FIG. 4, a relatively broad base portion 25 which is generally concave and is defined by a plurality of levers or tread members 14–40. More prticularly, the tread members 14, 16, 18, 20, 22, 24 and 26 extend downwardly and outwardly from the central portion of outer surface 13 toward one side peripheral portion thereof, while an opposed set of tread members 28, 30, 32, 34, 36, 38 and 40 extend downwardly and outwardly in the opposite direction from the other side of the sole. As may be appreciated, the tread members on the left and right sides of the outer sole are arranged in opposed, aligned pairs, such as tread members 16 and 30, so as to coact in a manner which will be explained in greater detail hereinafter.

It may be appreciated from FIGS. 3 and 4 that each of the tread members, such as tread members 16 and 30, generally may be said to include a downwardly and outwardly inclined lower wall 42 and 44, respectively, as well as respective downwardly and outwardly inclined upper walls 46 and 48. As disclosed in applicant's prior application Ser. No. 185,957, now U.S. Pat. No. 4,372,058, tread members 16 and 30, and particularly lower walls 42 and 44 thereof, make an obtuse angle with the outer surface 13 of the sole, and more particularly with the central portion of the outer surface. Reference numeral 52 refers to a relatively thin, downwardly and inwardly inclined lower portion of side wall 19 which, at the junction with upper wall 46 of tread member 16, forms an outwardly facing groove 50 at the junction of each tread member with the side wall 19. Groove 50 defines the outer periphery of side wall 19, and it may be appreciated that the tread members extend a substantial distance beyond such outer periphery so that, upon contacting the ground, the tread member 16, for example, will flex more readily upwardly as a result of the lack of resistance immediately above upper wall 46. Further, lower portion 52 of side wall 19 will serve as a stop surface to limit upward movement of lug 16, as will be explained in greater detail hereinafter.

Although the illustrated shape of the tread members is somewhat rectangular in plan and triangular in section, it may be appreciated that any of a number of shapes and configurations are capable of performing the same shock absorbing and dissipating functions as herein set forth. The important qualities are that the tread members extend downwardly and outwardly from the central to the peripheral portion of the outsole to form a transverse concavity such that the tread members compress and spread laterally outwardly upon foot-induced ground impact to dissipate shock components away from the central portion of the sole, and hence the foot of the wearer.

The lower walls 42 and 44 of the tread members may also be provided with gripping recesses 54 or the like to increase frictional stability. It is also noted from FIGS. 1 and 2 that the heel portion 56 is provided with an upper wall 58 that defines a groove 60 at the junction with side wall 19 so that heel 56 can react in much the same manner as the other tread members.

Figure 2:
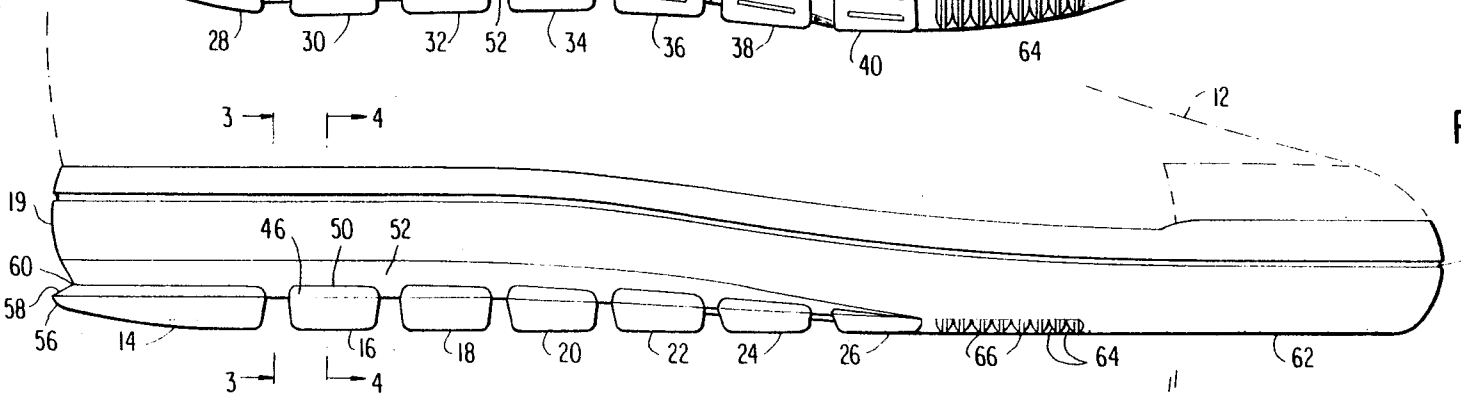
FIG. 2 is a side view in elevation of the preferred embodiment illustrated in FIG. 1.

Referring still to FIGS. 1 and 2, it may be appreciated that in the forefoot portion of the sole 10 there is formed a somewhat oval herringbone or similar tread surface 62 to provide surface friction. A plurality of ridges 66 extend transversely across that portion of the outer sole above which the metatarsal heads of the foot are positioned. Ridges 66 form transverse grooves 64 therebetween to facilitate forefoot flexing. Positioned generally under the head of the ball of the great toe is a pivot stud 70 preferably in the form of a concave cup about which are formed concentric part-circular grooves 68 which are an extension of the grooves 64. This construction facilitates simultaneous flexing and pivoting of the foot.

The inner construction of shoe sole 10 (not normally in view when the sole 10 is attached to the upper 12) is of considerable importance to the the present invention. As viewed in FIGS. 3–5, the inner construction includes a centrally formed, relatively rigid pedestal structure indicated generally by reference numeral 100. The pedestal structure 100 is designed to cooperate with the outer tread members to produce the optimum shock absorbing action, as will be hereinafter described.

The pedestal structure 100 comprises a plurality of substantially parallel transverse main walls 72–84 which extend substantially vertically upwardly from the inner surface 17. Each main wall preferably extends along the approximate transverse centerline of a respective opposed pair of tread members. For example, wall 74 is formed along the transverse centerline of tread members 16 and 30, as may be appreciated from FIG. 5.

Supporting the ends of main wall 74, and acting as a transition structure to the outer tread members, are two pair of substantially triangularly shaped support members 92 and 94. A pair of side support walls 86 and 88 extend longitudinally of inner surface 17 and connect the respective ends of each of the transverse main walls 72–84. A central longitudinally arranged support wall 90 may also be provided to further stiffen and support the pedestal structure.

Positioned midway between adjacent transition side support members 92 and 94 of the inner walls 72–94 are a pair of opposed, substantially rectangular auxiliary support members 96 and 98 whose height is substantially the same as that of the transverse main walls 72–84.

An inwardly extending rib 102 serves as a ledge for fibrous board 15 (FIG. 3) and also defines therebelow a cavity 104 which extends about the periphery of the inner surface 17. Other boundaries of cavity 104 include the pedestal structure 100, side wall 19 and inner surface 17.

The presence of cavity 104 immediately above the tread members further reduces resistance to flexure and allows the lugs to compress even more rapidly. Since the distance that the tread members travel upon ground impact is important to the amount of shock that can be absorbed or dissipated, cavity 104 is of extreme significance in permitting a greater distance of compression, flexure or movement of, for example, lever 16 before upper wall 46 thereof meets side wall 52. The relatively rigid central pedestal structure 100 forms a connecting bridge for the cantilevered tread members and permits same to be fully compressed while the foot is properly supported. Side wall 52 is preferably thinner and thus inherently more resilient than side wall 19 so as to further reduce resistance to the compressibility and flexure or movement of the tread member therebelow. In the foregoing ways, the shock absorption qualities of this shoe sole are greeatly increased.

It will be noted from FIGS. 1, 2 and 5 that the central inner structure tapers frowm the heel towards the toe to a position where it merges into a substantially planar forefoot inner surface. The inner construction therefore is compatably designed with the outer construction wherein the tread members are provided only up to the transverse metatarsal arch. In the game of basketball, it is believed to be more important to cushion shock at the initial heel strike, while the forefoot of the shoe is designed for the other basketball foot movements of flexing and pivoting.

The present invention also provides improved stability in that the base 25 is wider, generally by the degree of lateral extension of the tread members, than in a normal basketball shoe. Further, as the shoe tips to the left or right, the tread members tend to extend their edge-formed fulcrum point by stretching, bending and compressing, thereby further increasing stability and preventing premature out-of-balance conditions and consequent ankle stress.

Obviously, numerous modifications and variations of the present invention are possible in light of the above teachings. It is therefore to be understood that, within the scope of the appended claims, the invention may be practiced otherwise than as specifically described herein.

I claim as my invention:

1. A sole for a court shoe, which comprises:

an outer surface having a central portion and a peripheral portion;

a plurality of resilient tread members extending downwardly and outwardly from said central portion to said peripheral portion of said outer surface to form a transverse concavity;

an inner surface having a central portion and a peripheral portion;

a side wall extending upwardly from said peripheral portion of said inner surface so as to define cup means adapted to receive a shoe upper therewithin;

said tread members adapted to be flexed upwardly and spread laterally outwardly upon foot-induced ground impact for dissipating shock away from the foot; and cavity means provided about said peripheral portion of said inner surface of said sole for facilitating flexing of said tread members, said cavity means comprising a space positioned adjacent said side wall about said peripheral portion of said inner surface under said cup means and above said tread members for reducing resistance to movement of said tread members upon flexing of said tread members upon foot-induced ground impact.

2. A sole as set forth in claim 1, wherein said side wall includes a flexible lower portion positioned above said tread members and inclined towards said central portion of said outer surface for further facilitating flexing of said tread members towards said cavity means.

3. A sole as set forth in claim 1, wherein said tread members and said cavity means are not formed about the frontal portion of said sole.

4. A sole as set forth in claim 1, wherein said cavity means is not formed forwardly of the approximate metatarsal region of said sole.

5. A sole as set forth in claim 4, further comprising substantially rigid pedestal means formed in said central portion of said inner surface for further supporting said upper, said cavity means being defined by the space between said pedestal means and said side wall.

6. A sole as set forth in claim 5, wherein said cup means comprises a support flange integrally extending inwardly from said side wall above said cavity means towards said pedestal means.

7. A sole as set forth in claim 5, wherein said pedestal means comprises a plurality of main walls extending transversely across said central portion of said inner surface, each of said main walls being aligned along the approximate transverse centerline of a respective opposed pair of said tread members.

8. A sole as set forth in claim 7, wherein said pedestal means further includes main wall support members extending downwardly and outwardly from the ends of each said main walls toward said side wall.

9. A sole as set forth in claim 8, wherein said main wall support members are substantially triangularly shaped.

10. A sole as set forth in claim 7, wherein said pedestal means further includes left and right side support walls connecting the ends of said main walls and extending longitudinally along said inner surface.

11. A sole as set forth in claim 10, further comprising supplementary support members extending outwardly from said left and right side support walls toward said side wall, said supplementary support members being positioned above the space formed between a respective pair of adjacent tread members.

12. A sole as set forth in claim 6, wherein said pedestal means and said support flange taper downwardly from the heel portion of the sole towards the toe portion thereof.

13. A sole as set forth in claim 1, wherein said tread members are arranged in pairs along opposed sides of said outer surface and are formed from the heel of the sole up to the metatarsal region of said sole.

14. A sole as set forth in claim 1, wherein said tread members extend laterally beyond the junction thereof with said side wall.

15. A sole as set forth in claim 1, further comprising groove means extending transversely along said outer surface across the metatarsal heads for facilitating flexing of the foot thereat.

16. A sole as set forth in claim 15, further comprising means formed in said outer surface under the position of the ball of the great toe for facilitating pivoting of the foot thereat.

17. A sole as set forth in claim 16, wherein said pivoting means comprises a pivot cup.

18. A sole as set forth in claim 17, wherein said groove means extends concentrically about said pivot cup.

19. A sole as set forth in claim 1, further comprising:

a plurality of parallel grooves in said outer surface for facilitating flexing of the foot at the metatarsal heads;

a pivot cup formed in said outer surface under the position of the ball of the great toe for facilitating pivoting of the foot thereat; and wherein each said groove comprises inner, middle and outer sections, said inner and outer sections extending transversely across the metatarsal heads on either side of said pivot cup, and said middle section extending substantially in a semicircle around the peripheral of said pivot cup and uniting said inner and outer sections.

20. A unitary sole for a court shoe, which comprises:

an outer surface having a central portion and a peripheral portion;

a plurality of resilient tread members extending downwardly and outwardly from said central portion to said peripheral portion of said outer surface to form a transverse concavity;

an inner surface having a central portion and a peripheral portion;

a side wall extending upwardly from said peripheral portion of said inner surface so as to define cup means adapted to receive a shoe upper therewithin;

said tread members adapted to be flexed upwardly and spread laterally outwardly upon foot-induced ground impact for dissipating shock away from the foot;

cavity means provided about the peripheral portion of said inner surface of said sole for facilitating flexing of said tread members, said cavity means comprising a space positioned adjacent said side wall about said peripheral portion of said inner surface under said cup means and above said tread members for reducing resistance to movement of said tread members upon flexing of said tread members upon foot-induced ground impact;

wherein said side wall includes a flexible lower portion positioned above said tread members and inclined towards said central portion of said outer surface for further facilitating flexing of said tread members towards said cavity means; and wherein said tread members and said cavity means are not formed about the frontal portion of said sole.

21. A unitary sole for a court shoe, which comprises:

an outer surface having a central portion and a peripheral portion;

a plurality of resilient tread members extending downwardly and outwardly from said central portion to said peripheral portion of said outer surface to form a transverse concavity;

an inner surface having a central portion and a peripheral portion;

a side wall extending upwardly from said peripheral portion of said inner surface so as to define cup means adapted to receive a shoe upper therewithin;

said tread members adapted to be flexed upwardly and spread laterally outwardly upon foot-induced ground impact for dissipating shock away from the foot;

cavity means provided about the peripheral portion of said inner surface of said sole for facilitating flexing of said tread members, said cavity means comprising a space defined by peripheral portions of said inner surface of said sole for reducing resistance to movement of said tread members upon flexing of said tread members upon foot-induced ground impact;

wherein said cavity means is not formed forwardly of the approximate metatarsal region of said sole; and further comprising substantially rigid pedestal means formed in said central portion of said inner surface for further supporting said upper, said cavity means being defined by the space between said pedestal means and said side wall.

22. A sole as set forth in claim 21, wherein said side wall includes a flexible lower portion positioned above said tread members and inclined towards said central portion of said outer surface for further facilitating flexing of said tread members towards said cavity means.

* * * * *